United States Patent [19]

Nechville

[11] Patent Number: 5,033,349

[45] Date of Patent: Jul. 23, 1991

[54] STRINGED INSTRUMENT

[76] Inventor: Thomas Nechville, 10021 - 3rd Ave., South, Bloomington, Minn. 55420

[21] Appl. No.: 542,910

[22] Filed: Jun. 25, 1990

[51] Int. Cl.[5] ..... G10D 1/10

[52] U.S. Cl. ..... 84/272; 84/318

[58] Field of Search ..... 84/269-272, 84/315-318, 293

[56] References Cited

U.S. PATENT DOCUMENTS

| | | | |
|---|---|---|---|
| 394,530 | 12/1888 | Wood | 84/269 |
| 504,810 | 9/1893 | Luscomb | 84/269 |
| 559,302 | 4/1896 | Merrill | 84/272 |
| 582,030 | 5/1897 | Walker | 84/293 |
| 775,711 | 11/1904 | Turney | 84/411 R |
| 1,371,760 | 3/1921 | Grover | 84/269 |
| 1,378,212 | 5/1921 | Bolander | 84/269 |
| 1,501,725 | 7/1924 | Reger | 84/272 |
| 1,595,451 | 8/1926 | Cole et al. | 84/411 A |
| 1,932,975 | 10/1933 | Kuhrmeyer | 84/293 |
| 2,061,244 | 11/1936 | Au-Miller | 84/411 A |
| 2,425,996 | 8/1947 | Cordes | 84/411 A |
| 2,746,337 | 5/1956 | Smit | 84/317 |
| 3,205,751 | 9/1965 | Lowe | 84/318 |
| 4,222,303 | 9/1980 | Kryzanowski | 84/315 |
| 4,279,188 | 7/1981 | Scott | 84/411 A |
| 4,688,461 | 8/1987 | Stroh | 84/298 |
| 4,856,404 | 8/1989 | Hughes | 84/297 R |

*Primary Examiner*—Brian W. Brown

[57] ABSTRACT

A stringed instrument construction including a neck attached to an annular housing and having its acoustic components such as soundboard and rim mounted concentrically in the housing. Rather than having multiple tensioning hooks and brackets to tighten around the perimeter of the soundboard as in a banjo, this instrument employs an annular threaded connection between the acoustic components and the housing. A gear and pinion aparatus is used to facilitate turning the inner threaded portion within the external housing. There is no need for coordinator rods therefore the acoustic components can resonate more freely, providing better sound. The neck is connected to the housing at a radiused interface which enables ample adjustment of the neck's angle. The neck features a track mounted self adjusting capo, and an optional track mounted single string capo. It also offers the convenience of tuning all the strings at the peghead rather than having a protruding fifth string from the side of the neck as on a five string banjo. This construction enables the use of differing acoustic components to achieve differing sounds; quick assembly and disassembly and easier maintenance and playability.

8 Claims, 2 Drawing Sheets

FIG. 1
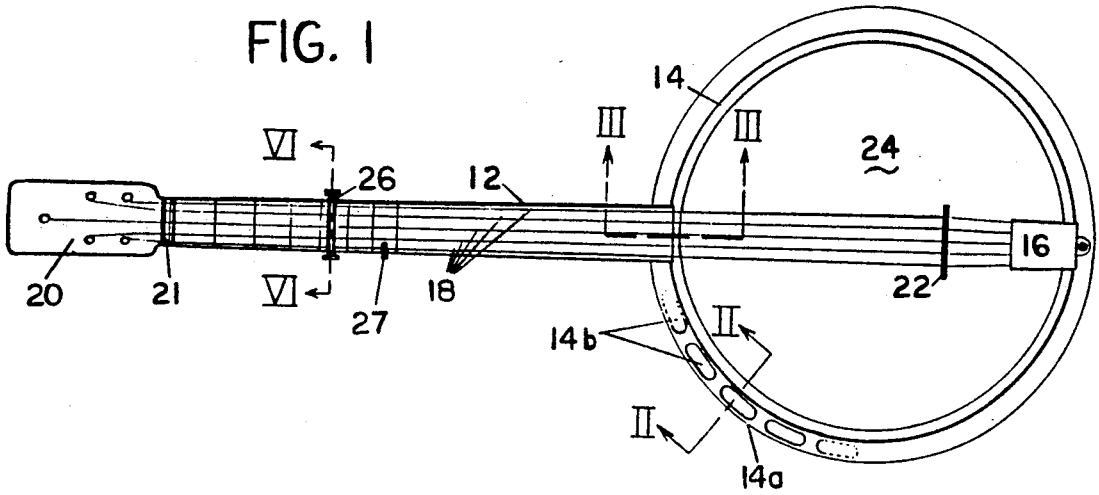
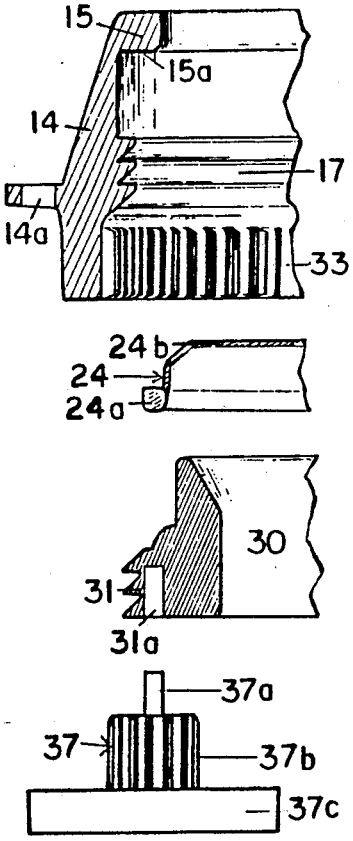
FIG. 2
FIG. 3
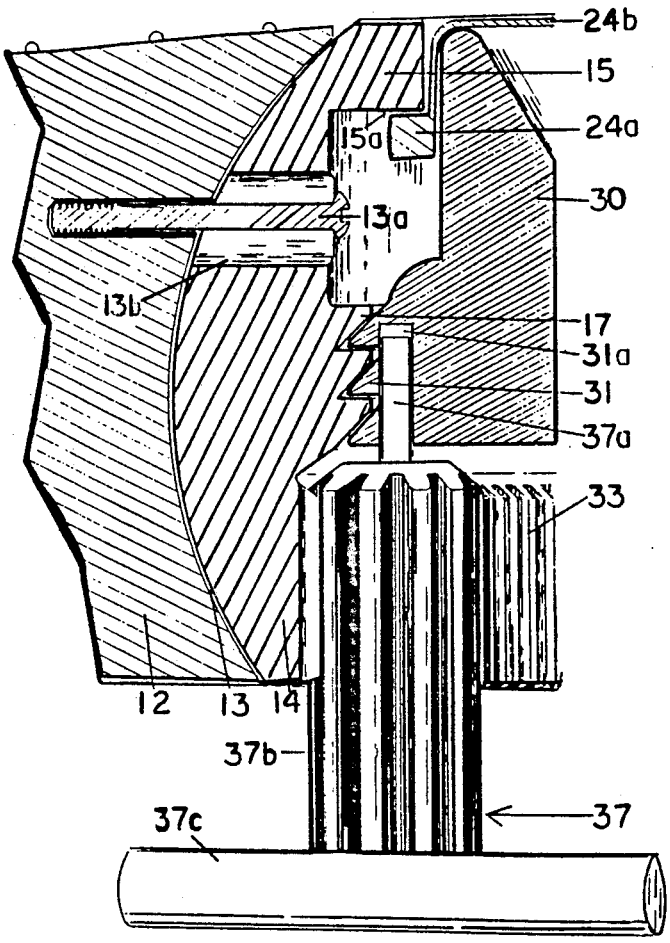

STRINGED INSTRUMENT

BACKGROUND OF THE INVENTION

This invention relates to the field of musical instrument construction. It is especially relevant to, but not limited to banjo construction.

The physics of sound generation are complex and largely beyond the scope of this invention. I will, however, describe the differences between sound producing parts of an instrument and those parts whose primary function is structural. The purpose of this explanation is to fully understand the objects and advantages of this new instrument construction.

Most stringed musical instruments have a soundboard mounted to a rim. These parts are meant to actively participate in generating and defining the sound of an instrument. The soundboard, rim and usually a sound reflecting back are the main resonating components of a stringed instrument. String vibrations are transmitted through a bridge and to the soundboard. As the soundboard is set in motion by the string vibration, the sound is amplified by its large resonating surface. The soundboard, rim and back all resonate and define an air space that also resonates. I will call the sound producing parts acoustic members. A resonant chamber is defined as the assembled acoustic members and resulting air space defined therein.

Structural members as distinct from acoustic members, would be those parts with a primarily structural purpose. Examples would include the following; top bracing of a guitar to provide support for string attachment, hardware for securing and tensioning a drum or banjo's soundboard, a neck providing a rigid connecting point for the strings, and a tailpiece providing a rigid connecting point for the other end of the strings.

In current practice it is not possible to isolate the acoustic members from the structural members. All members are secured together so sound vibrations from an acoustic member will pass to the structural members. In fact, the structural members can effect the overall sound substantially. Ideally they should not add distorting vibrations or dampen the desirable acoustic vibrations. The banjo example will illustrate some of the problems encountered when designing an instrument with good structural and acoustic properties.

The rim of a banjo is an important acoustic member but it also must bear the stresses of the neck, string and soundboard attachments. The direct contact between the neck and rim can absorb and impede the rim's natural resonance. Also the rim structure can yield to the neck's distorting string tension and warp. In this case the neck angle changes leaving the strings uncomfortably far from the neck's playing surface. Most banjos, therefore, employ one or two reinforcing rods installed across the rim's diameter. Adjustment of the rods can help a rim retain its circular shape resulting in proper neck angle and correct string height. The problem is that tightening these rods will also impart sound dampening stresses to the rim. The resulting sound is often too thin and weak, especially in the lower frequency range.

Typical banjo construction employs many parts to tension the membrane style soundboard. Multiple tension hooks are positioned around the perimeter of the instrument's body. It is necessary to take extreme care in tightening each tension hook uniformly to avoid membrane breakage. Assembly and proper attainment of membrane tension is extremely time consuming and requires a degree of skill.

Some "top tension" banjo designs of the past attempted to simplify the task of soundboard or head installation and maintenance. They offered multiple tensioning screws that were adjustable from the top of the instrument. Numerous other tension adjusting mechanisms were devised in the prior art of banjo construction but nearly all involved tightening multiple fasteners around the instruments' perimeter.

As mentioned previously, banjo necks are usually attached to the rim assembly via reinforcing rods or dowels. They are fastened to the neck and pass across the rim's diameter. One rod usually goes through the opposite side of the rim and is secured with nuts on either side of the rim. Adjustment of the rods or nuts will deflect the shape of the rim. This distortion enables slight neck angle and string height adjustability. Overadjustment can lead to dampened or restricted tone and damage to the instrument. There is a need for a better neck connection that puts no distorting stress on the acoustic members but allows for a wider range of adjustability.

Banjos exist with any number of strings but currently the most popular style is the five string banjo. The fifth string is usually attached to a tuning peg which is protruding out from the side of the neck. The fifth string's shorter length is necessary to achieve a high pitch without breaking. This peg can often get in the way while playing, especially if the player uses his thumb to fret strings. Another shortcoming of this peg is that it is stationary. Certain tunings may call for lower or higher pitch on the fifth string. Without a means to change the string's length, adequate pitch adjustment is impossible. The neck widens on the side of the neck where the fifth string starts. The overall shape of the neck is therefore asymmetric. This makes it impossible for a right-handed instrument to be restrung for use by a left-handed player.

In some instruments such as the European Zither-Banjo, a portion of the fifth string passes through a tunnel in the neck from the fifth fret to the peghead. This method allows tuning at the peghead without the cumbersome fifth string peg, but does not solve any other of the above problems and is difficult to manufacture.

Another problem which relates to the necks of stringed instruments such as guitars and banjos is the inconvenience associated with using a capo. A capo is a bar device used to shorten the effective length of the scale in order to play in different keys more easily. The capo's clamping pressure down on the strings makes the instrument slightly out of tune. Frequent retuning is required when affixing or removing a capo. Besides minimizing the tuning problems, it is also desirable to minimize the time required to engage a capo. Many attempts have been made to make them more effective and convenient. The Shubb adjustable capo, U.S. Pat. No. 4,250,790 is an example of one of the more sophisticated designs. The fifth string of a banjo is usually capoed five frets up the neck, separately from the main capo. Devices such as small hooks driven into the neck or some other type of bar mounted clamp that slides along the side of the neck are normally used. Shubb's Capo For Five String Banjo U.S. Pat. No. 3,834,267 is one such sliding single string capo. All clamp-down style capos, including fifth string capos, tend to oversharpen the strings and take time to adjust. Most capos also tend to become lost if not permanently affixed to the neck.

OBJECTS AND SUMMARY OF THE INVENTION

In view of the foregoing limitations and shortcomings of the prior art, there exists a need for a stringed instrument construction that solves the above mentioned problems. It is therefore the primary objective of this invention to provide a stress free method of mounting an instrument's neck and strings. My design shifts the distorting stresses normally placed upon the rim of an instrument to a rigid structural housing. There is no longer a need for reinforcing rods. The housing assumes the structural role of neck and tailpiece attachment. The rim and whole resonant chamber mounts concentrically inside the housing. It is free to produce an unrestrained and fuller sound.

My instrument uses none of the conventional hardware to tension the soundboard and is much simpler to operate. I have replaced the numerous hooks, nuts and related tensioning hardware with one structural retension housing. It distributes uniform tension around the perimeter of the soundboard very quickly and easily.

My instrument design does not require reinforcing rods but offers a simpler and more effective means for neck attachment. The structural housing fastens directly to the neck via screws or similar fasteners. Slotted holes in the housing allow for ample up and down neck adjustment. A radiused interface is provided between the neck and housing to permit wide adjustability of string height.

Unlike a current five string banjo neck, my instrument's neck is symmetric and therefore can be set up to be played by right or left handed people. Its shape can be readily manufactured more cost effectively by lathe turning rather than hand shaping. My instrument can accommodate strings all of equal length as in a guitar or can be set up with one or more shorter, high pitched strings as on a five string banjo.

A sliding capo system is built into the neck for shortening such strings. Both the short string capo and a main capo slide along tracks embedded on either side of the neck. The capo's tension is always kept on the strings, even while the capo is not in use. Consequently there is no tendecy for the strings to raise out of tune when the capo is engaged. Operation of this capo is simply a matter of pushing or pulling it into position.

In summary, the preferred embodiment of this invention provides a new stringed instrument with several novel features and benefits. Rather than using multiple tension hooks positioned around the perimeter of the soundboard, this invention employs the use of an annularly threaded connection between the acoustic chamber rim and the retension housing to mount and tension the soundboard.

The neck offers a built in capo, a single string capo and a capo track. It also offers the convenience of tuning all the strings at the peghead rather than having a protruding fifth string from the side of the neck. This construction allows for many advantages, some of which are listed here;

A retension housing assumes all the stresses from neck and hardware attachment, enabling fuller sound.

A tightening assembly which applies uniform tension evenly to the entire surface of membrane soundboard, allowing higher membrane tension with less chance of membrane breakage.

The acoustic members are free from structural requirement enabling lighter and more resonant materials to be used.

Many parts are eliminated which enables much quicker and lower cost assembly and disassembly.

The ease with which this instrument can be assembled and disassembled is a major benefit to the user because;

1. It is possible to change or adjust any acoustic member without removing strings, and in a fraction of the time of any prior art.
2. It allows for use of easily interchangeable components for customizing the sound of the instrument to meet the exact needs of the player. For example a wooden or metal soundboard might be added to create guitar or dobro sounds.

Easily manufactured with modern machining equipment.

Better adjustable neck attachment. No longer a need for reinforcing rods, enabling a widely adjustable neck connection.

Convenient built in capo that keeps the instrument in better tune when capo is engaged.

BRIEF DESCRIPTION OF THE DRAWINGS

The drawings illustrate an embodiment of the instrument of the invention in which, FIG. 1 is an overall top view of the instrument FIG. 2 is an exploded sectional view taken on line II—II of FIG. 1 in relation to a tensioner pinion wrench.

FIG. 3 is a sectional view in cutaway taken on line III—III of FIG. 1 showing engaged pinion wrench.

DETAILED DESCRIPTION OF THE INVENTION

Figure 4:
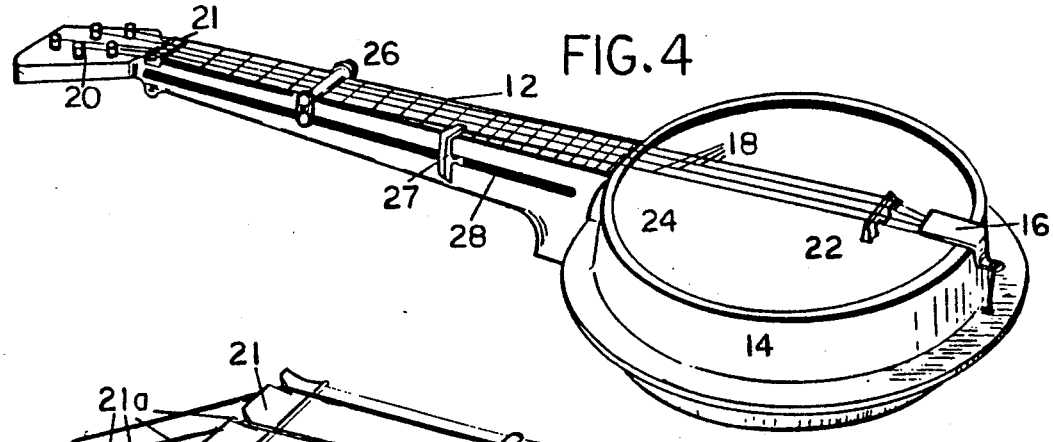
FIG. 4 is an overall isometric view of the instrument

One embodiment of my instrument is illustrated in FIG. 1. The neck 12 mounts to the retention housing 14. A tailpiece 16 attaches to the other side of the housing 14. Strings 18 connect at the tailpiece 16 and at the peghead 20 in a conventional manner. The strings 18 pass over a nut 21 and are stretched over a bridge 22 which contacts a drumhead style soundboard 24. A Capo 26 is connected to neck 12 via capo tracks 28 which are shown on drawings 4–7. A single string capo 27 is also shown capoing one of the strings 18.

As shown in FIG. 2, the internal surface of the housing 14 has three main features. First, at the top of housing 14 is a reduced diameter flange 15. The undersurface **15*a* of flange 15 contacts an outer hoop 24*a* of a soundboard 24. The soundboard 24 illustrated is a preformed banjo style soundboard which consists of a flexible membrane 24*b* mounted to the outer hoop 24*a*. The soundboard 24 mounts between the retention housing 14 and an acoustic chamber rim 30**.

Second, an annular, threaded section 17 within the inner annulus of housing 14 mates with an annularly threaded flange 31 concentric to the acoustic chamber rim 30. A solid, yet adjustable connection is made between the outer housing 14 and the inner rim 30 through the mating of threaded portions 17 and 31. For clarity the flange 31 is illustrated as an integral feature of the acoustic chamber rim 30 but in practice it may be a separate part. The threads of 17 and 31 preferably should be buttress style and of relatively small pitch such as 10 threads per inch or more. The minor diameter of threaded section 17 should be larger than the outer diameter of the soundboard 24 to allow easy installation of the soundboard 24 through back of housing 14.

The third feature of the internal surface of housing 14 is an annular internal gear 33. The gear's teeth should be straight, not beveled or helical and have a relatively small pitch, such as 24 or 32 diametrical pitch. The diameter of gear 33 must be large enough to allow free passage of flange 31 during assembly and disassembly.

A pinion wrench 37 as shown in FIG. 2 is a tool for tightening or securing the soundboard. One end has a hardened pin **37*a* that slip fits into a hole 31*a* in the acoustic chamber rim flange 31. Wrench 37 has a geared pinion shaft 37*b* that mates with the housing gear 33 when pin 37*a* is engaged in hole 31*a*. Pinion shaft 37*b* can be fashioned from standard drawn pinion wire such as supplied by Boston Gear Division of Incom International Inc. A T-shaped handle 37*c* is securely fastened to the pinion shaft 37*b*. Turning the wrench 37 causes the flange 31 to rotate in relation to gear 33**.

The outer surface of housing 14 has an optional flange **14*a* with openings 14*b* to allow sound escapement as shown in both FIGS. 1 and 2**. The flange connects to an optional back or resonator which is not shown in the drawings.

FIG. 3 shows the assembled components of the prior discussion in cross section at the point of neck connection, or along line III—III of FIG. 1. The last important feature of the housing 14 is a radiused neck connection surface 13. The neck 12 has a heel cut **12*a* to match radiused surface 13. The neck's heel 12*a* is anchored to housing 14 at surface 13 by at least one fastener 13*a*. This fastener 13*a* passes through a slot 13*b* in area 13**.

Figure 5:
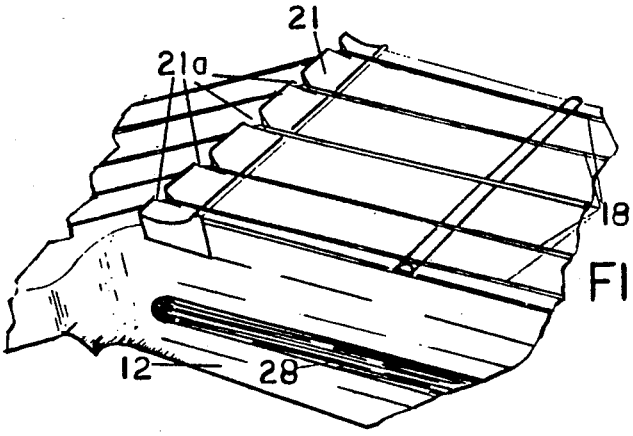
FIG. 5 is an isometric detail of the neck's nut

FIG. 4 shows the overall instrument with the capo 26 engaged at the 5th fret of neck 12. The single string capo 27 is shown slidably mounted in track 28 at the 10th fret of neck 12. FIG. 5 shows the end of track 28 ending at the nut 21. The strings 18 pass through spacing grooves **21*a* in nut 21**.

Figure 6:
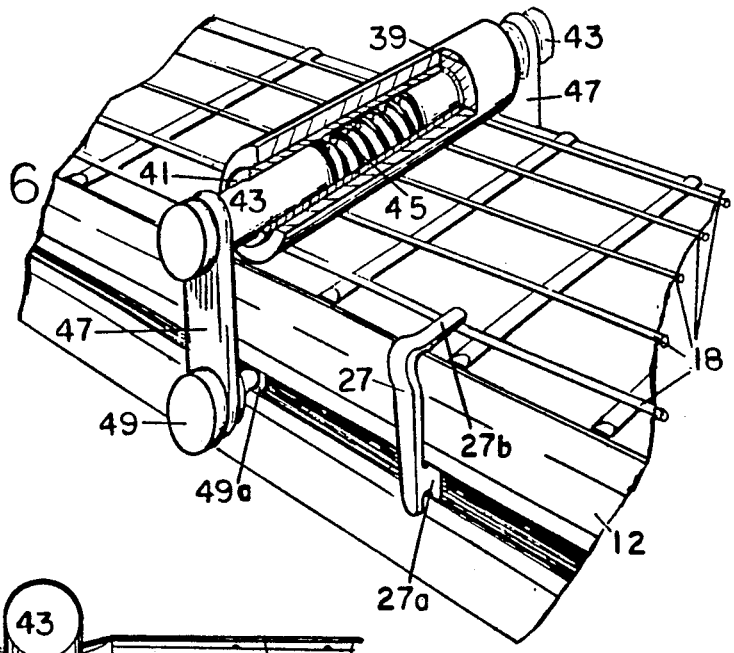
FIG. 6 is a isometric view of the neck and capo. The capo is partially cutaway on line VI—VI of FIG. 1

FIG. 6 shows a close up view of the main capo 26 and the single string capo 27. The single string capo 27 may be made in one piece from reinforced plastic or a suitable metal. The lower portion of capo 27 includes a dovetail, or H-shaped track follower **27*a* which fits into and slides along track 28. The capo 27 has a spring finger section 27*b* extending out over the top of neck 12. One of the strings 18 is placed between finger 27*b* and top of neck 12. A tab 27*c* is provided at the lower end of capo 27 to counter any tendency for capo 27 to tilt away from neck 12 and become ineffective. Capo 27 should be sized so that finger 27*b* will push string 18 downward against neck 12 with enough spring tension to effectively capo the string 18 but should not be so tight as to prevent sliding the capo 27 over the frets of neck 12. The embodiment shown in FIGS. 4 and 6 is the simplest way I've found to capo one string. It may be desirable to provide an adjustable pivot arm in place of the spring finger 27*b***. More elaborate track mounted capo mechanisms may be used without departing from the scope and intent of this invention.

Referring to the partial cross sectional view of capo 26 in FIG. 6, A resilient sleeve 39 fits over a rigid tube 41. The tube 41 has 2 core pins 43 that slip fit into each end of tube 41. The pins 43 are separated by a compression spring 45. The ends of pins 43 that protrude past the edge of the neck 12 are connected to extension springs 47 which could be made from rubber. The other ends of the rubber springs 47 connect to guides 49 which follow inside the tracks 28. The springs 47 provide enough tension to securely capo strings 18 and to hold core pins 43 substantially within the tube 41. The guides 49 are fashioned with a dovetail or H-shaped end **49*a* similar to follower 27*a*. Guides 49 will not pull out once slid into the track 28 from one end. The capo 26 self adjusts to the differing widths of neck 12 as it is pushed up and down neck 12**. More on this in the operation section to follow.

Figure 7:
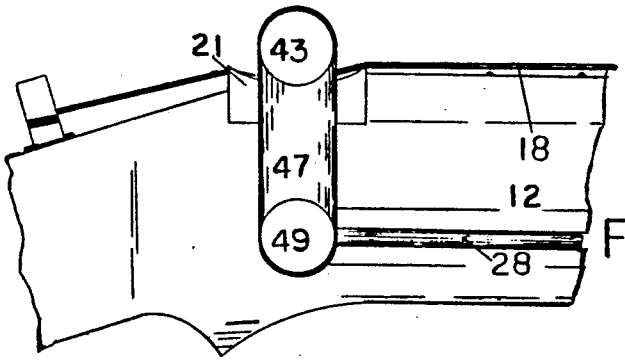
FIG. 7 is a side view of the capo on the nut or zero fret position.

FIG. 7 shows a side view of the capo of the invention mounted in the zero fret position. The strings 18 pass between the nut 21 and the capo's sleeve 39. The nut 21 has a concave recessed top as viewed from the side. When strings are capoed between the sleeve 39 and the recessed top of the nut 21 the strings 18 are held under the same tension as when capo 26 is engaged.

OPERATION OF INVENTION

The bridge 22, shown in FIG. 1, is employed to transfer sound from the vibrating strings 18 to the soundboard 24 as in any string instrument. Referring to FIG. 2 or 3, the soundboard outer hoop **24*a* is retained by the housing flange 15. Its vibrating membrane 24*b* is stretched across the top of the acoustic chamber rim 30. Mounting and tightening the soundboard 24 is done by engaging the threaded flange 31 of the acoustic chamber rim 30 within the annularly threaded section 17 inside the housing 14. Rotation of the threaded flange 31 creates a helical attachment along the annular thread 17 of the housing 14 sufficient to maintain but not dampen the resonating acoustic chamber rim. Clockwise radial motion of flange 31 within housing 14, helically pushes acoustic chamber rim 30 up tightening membrane 24*b***. Counter motion does the reverse.

The embodiment illustrated employs a method of turning the acoustic chamber rim 30 within retention housing. The pinion wrench 37 acts as a tightening tool to supply sufficient torque to properly secure soundboard 24. The pinion shaft **37*b* engages the housing gear 33 while the pinion pin 37*a* fits into flange hole 31*a*. Turning the pinion wrench 37 will cause pinion shaft 37*b* to travel radially along the pitch diameter of housing gear 33. The engaged pin 37*a* will push flange and acoustic chamber rim 30 helically within housing 14 and membrane 24*b* tightening or loosening will result. Use of straight, vertically oriented gear 33 enables full engagement of pinion pin 37*a* in flange hole 31*a* through entire range of lateral positioning of flange 31 relative to retention housing. Counter clockwise twist will push flange 31 and acoustic chamber rim 30 in clockwise direction if threads 17 and 31** are right hand. The converse is true if threads are left hand.

As shown in FIG. 3, the angle of the neck 12 can be adjusted by loosening the fastener **13*a* and sliding the neck heel 12*a* up or down along the radiused connection surface 13. Lowering peghead 20 in relation to surface 13 will bring strings closer to neck 12. Up and down adjustment of neck is possible due to the vertical space allowance in fastener slot 13*b* through surface 13 of housing 14**.

FIG. 4 shows the capo 26 engaged at the fifth fret of neck 12. Capo rolls into position with a simple pull or push. Referring to FIG. 6, the core pins 26 perform as axels within the rigid tube 26. The spring 45 separates the core pins 43 to prevent binding of extension springs 47 along widening neck 12. Extension springs 47 create enough downward tension to effectively capo the strings 18 and equalize the separating force of spring 45. Resilient sleeve 39 acts as a pad to prevent rattling of strings 18.

FIG. 7 shows the capo resting in the disengaged position of the zero fret or nut 21. The tension of the extension springs 47 is the same in the zero fret position as when the capo 26 is engaged. Hence, there is no tendency to lose accurate tuning after engaging or disengaging capo 26.

The reader will see that the musical instrument of the invention provides a convenient and versatile improvement to existing string instruments and effectively solves many of their problems.

While my above description contains many specificities, these should not be construed as limitations on the scope of the invention but rather as an exemplification of one embodiment thereof. Many other variations are possible. Referring again to FIG. 2 of the banjo embodiment, the gear 33 and pinion wrench 37 mechanism may be replaced by an alternate means of tightening. For example, a spanner wrench or similar lever could perform the same job. Many other designs are possible such as having a removable gear 33 that is used only when adjusting tension or changing components. Another option is to place the gear 33 on the acoustic chamber rim flange 31. With this design, the pinion wrench 37 would insert into a socket within the retention housing 14. The wrench 37 would remain seated in the socket while the gear 33 and acoustic chamber rim 30 turn. Other mechanical features may be employed such as roller bearings or an anti-friction gasket between the acoustic chamber rim 30 and the flange 31. It is also possible to provide other low friction interfaces where annular rotation occurs. If acoustic chamber rim 30 and threaded flange 31 are one piece, the rotational interface occurs either between the underside of the soundboard membrane 24*b* and the top of acoustic chamber rim 30 or between the undersurface of flange 15*a* and the top of soundboard outer hoop 24*a*.

Another embodiment of the invention would be to install a wooden or metal soundboard instead of the banjo style drumhead. Variations in materials and type of construction will result in different qualities of sound. Accordingly, the scope of the invention should not be limited to the embodiment illustrated above, but by the following claims and their legal equivalents.

I claim:

1. A musical instrument comprising:

a) an annular housing including a radially projecting flange having an aperture therethrough and further including an inner sidewall surface containing a first region having a plurality of annular threads and a second region having a plurality of vertical threads circumferentially extending about the housing;

b) a soundboard including a skin head drawn about an annular rib having a diameter greater than said flange and wherein said rib mounts in engagement with said flange and said skin head projects through said aperture;

c) an annular rim having an upper surface of a diameter less than the housing aperture, a plurality of apertures in a lower surface, a sidewall surface containing an annular projection radially extending outward therefrom and a first region containing a plurality of annular threads and wherein the first regions of the housing and rim mount in concentric relation to one another;

d) pinion means including a plurality of vertical threads and a handle portion for removably mounting in one of the rim apertures and mating with the threads of the second region of the housing such that upon rotating said pinion means said pinion means and rim rotate in unison about said housing to induce said rib into engagement with said flange and the upper rim surface into engagement with the skin head to vary the taughtness of said skin head;

e) neck means secured to said housing for supporting a plurality of strings between a portion of the neck means and the housing and including first and second grooves longitudinally extending along opposite surfaces of said neck means transverse to a plane containing the strings.

2. Apparatus as set forth in claim 1 including first capo means comprising:

a) a housing including a bore and an outer string contact surface portion;

b) first and second pegs each having portions mounting within said bore;

c) spring means mounted within said bore for biasing said first and second pegs away from one another;

d) first and second guides, each slidably mounted within a respective one of said first and second grooves; and e) first and second resilient link arms coupled between said first and second pegs and guides for compressively biasing said housing to contact selected ones of the strings.

3. Apparatus as set forth in claim 1 including second capo means comprising a first portion slidably mounting within one of said grooves and including an L-shaped arm having a minor arm portion which projects to engage at least one of said strings.

4. Apparatus as set forth in claim 1 wherein said neck and housing mount to one another at mating arcuate interface surfaces and whereat a threaded fastener longitudinally extends between said housing and said neck through a bore in said housing having a diameter greater than the threaded fastener, whereby the angular orientation between said housing and neck may be varied upon rotating said neck relative to said housing along the arcuate interface surfaces prior to tightening said threaded fastener and drawing said neck and housing into engagement with one another.

5. Apparatus as set forth in claim 1 including a plurality of said pinion means simultaneously operable to rotate said rim.

6. A musical instrument comprising:

a) an annular housing including a radially projecting flange having an aperture therethrough and further including a first sidewall surface containing a plurality of annular threads and a second sidewall surface containing a plurality of vertical threads circumferentially extending about the housing;

b) a soundboard including a skin head drawn about an annular rib having a diameter greater than said flange;

c) an annular rim having an upper surface of a diameter less than the housing aperture, a plurality of apertures in a lower surface, a sidewall surface containing a plurality of annular threads which mate with the threads of the first sidewall surface of the housing;

d) pinion means mounting in one of the rim apertures and including a handle portion and a plurality of vertical threads for removably mating with the rim and threads of the housing second sidewall surface such that upon rotating said pinion means said pinion means and said rim rotate in unison within said housing to induce the upper rim surface of the rim into engagement with the skin head and vary the taughtness of said skin head;

e) neck means for supporting a plurality of strings between a portion of the neck means and the housing and including means securing said neck means to the housing for varying the angular projection of the neck means relative to the housing and wherein first and second grooves longitudinally extend along opposite surfaces of said neck means transverse to a plane containing the strings;

f) first capo means including a housing having a bore, first and second pegs each having portions mounting within said bore and means mounted within said bore for biasing said first and second pegs away from one another, first and second guides slidably mounted within a respective one of said first and second grooves and first and second resilient link arms coupled between said first and second pegs and guides for compressively biasing an outer surface portion of said housing into contact with ones of said plurality of strings; and g) second capo means including a first portion slidably mounting within one of said grooves and an L-shaped arm having a minor arm portion which projects for engaging at least one of said strings.

7. A musical instrument comprising:

a) an annular housing including an aperture therethrough and further including a first sidewall surface containing a plurality of annular threads and a second sidewall surface having a plurality of threads circumferentially extending about the housing;

b) a soundboard including a play surface;

c) an annular rim having a sidewall surface containing a plurality of annular threads and wherein the threads of the first sidewall surface of the housing and rim mate with one another; and d) pinion means for removably coupling with the threads of the second sidewall surface of the housing such that upon rotating said pinion means said pinion means and rim rotate in unison within said housing to project said play surface through said aperture.

8. A musical instrument comprising:

a) an annular housing including a radially projecting flange having an aperture therethrough and a sidewall surface containing a plurality of threads;

b) a soundboard;

c) annular rim means having a first surface portion containing a plurality of threads and wherein the threads of the housing and rim mate with one another; and d) pinion means including a plurality of threads for removably mating with a threaded surface circumferentially extending about said instrument such that upon rotating said pinion means said pinion means rotates with and induces movement of a portion of said rim means within said housing to raise said soundboard into engagement with said flange.

* * * * *